United States Patent [19]

Walker

[11] Patent Number: 4,903,678

[45] Date of Patent: Feb. 27, 1990

[54] ARCHERY BOW CABLE GUARD

[76] Inventor: Beeby G. Walker, Rte. #1, Box 136 E, Yoncalla, Oreg. 97499

[21] Appl. No.: 222,140

[22] Filed: Jul. 21, 1988

[51] Int. Cl.[4] ..... F41B 5/00

[52] U.S. Cl. ..... 124/90; 124/DIG. 1; 124/88; 124/24 R

[58] Field of Search ..... 124/86, 88, 90, 24 R, 124/DIG. 1; 384/420, 911

[56] References Cited

U.S. PATENT DOCUMENTS 2,910,329 10/1959 Runton ..... 384/911
4,337,749 7/1982 Barna ..... 124/88
4,498,203 10/1984 Hayer ..... 124/88

OTHER PUBLICATIONS

"Archery", Jun. 1979.

*Primary Examiner*—Andrew V. Kundrat
*Assistant Examiner*—Carol I. Bordas
*Attorney, Agent, or Firm*—Boniard I. Brown

[57] ABSTRACT

A cable-guard structure for a compound archery bow, comprising two separate guide rollers freely rotatable on a rod-type support. The rollers are of different diameter to prevent direct contact between the cables at any point along the cable span.

4 Claims, 2 Drawing Sheets

FIG. 1
PRIOR ART
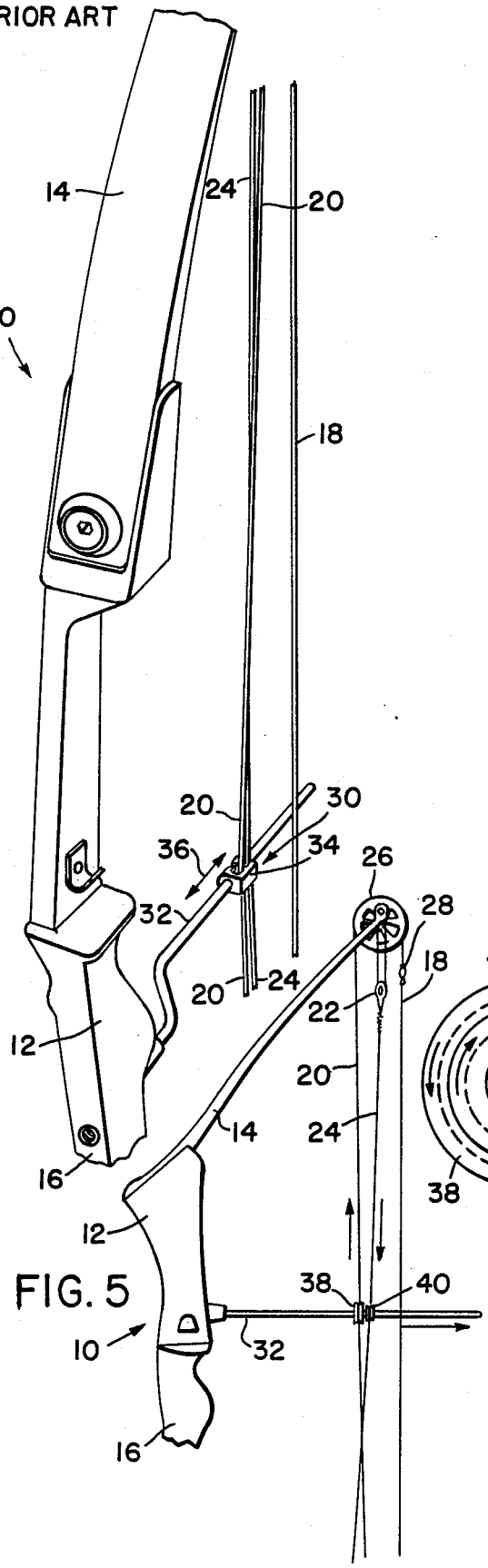
FIG. 2
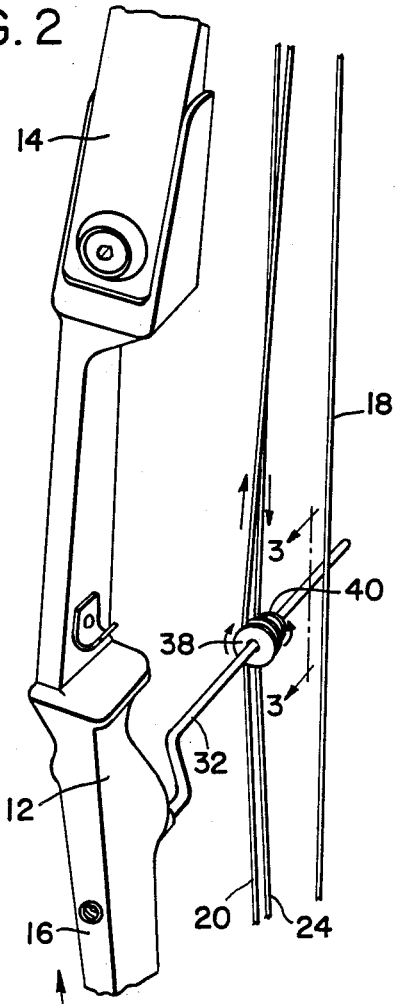
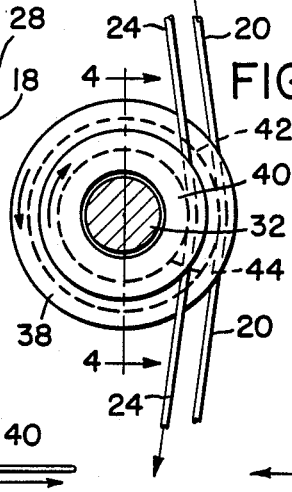
FIG. 3
FIG. 4
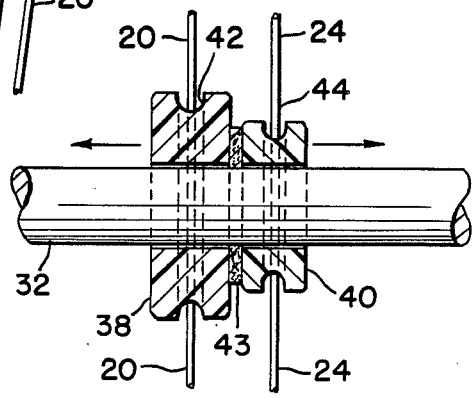
FIG. 5

ARCHERY BOW CABLE GUARD

BACKGROUND OF THE INVENTION

This invention relates to archery apparatus, especially compound bows and cable guards used on compound bows. Compound bows were devised to provide an increased tension force to the bowstring, with a corresponding increase in arrow velocity. Such bows include pulley means at the free ends of the bow limbs; cables are trained around the pulley means for connection to opposite ends of the bowstring.

The cables are in close adjacency to one another, especially near the midepoint of the bow where they cross one another. Under conventional practice a cable guide is extended from a midpoint on the bow and is offset laterally from the general plane of the bow structure to space the cables laterally from the position of an arrow during drawback or flight.

Usually the cable guard comprises a plastic member having two guide grooves therein, one for each cable. The grooved cable guides are not entirely effective in that substantial rubbing frictional forces are generated between the cables and the guide groove surfaces.

An improved anti-friction type cable guide design has been introduced by the Saunders Archery Co., of Columbus, Nebraska, under the tradename "6×6". The Saunders antifriction guide apparently comprises a rod-type support projecting from a mid point on the bow; a carriage is supported for movement along the rod-type support via two spaced rollers. Four other rollers are rotatably supported on the carriage for engagement with the two cables (two rollers for each cable).

SUMMARY OF THE INVENTION

My invention relates to a low cost alternative to prior Saunders cable guard structure. In my proposed structure two cable-guide rollers are freely supported directly on a guide rod extending from a mid point on the bow. The cable-guide rollers are of different diameters to space the cables laterally of the general plane of the bow structure, whereby the cables are prevented from directly contacting each other at point along the cable length. This is in contrast to conventional cable guide structures of the symmetrical type wherein both cables angle across the nominal cable path centerline (defined by the puller axes) at the same point along the cable span. In my proposed asymmetrical roller arrangement the cables cross the cable path centerline at different points, such that the cables cannot rub against each other.

BRIEF DESCRIPTION OF THE DRAWINGS

FIG. 1 is a fragmentary perspective view of a compound bow having a conventional cable guide thereon.

FIG. 2 is a view similar to FIG. 1, but showing the bow equipped with a cable guide constructed according to my invention.

FIG. 3 is a fragmentary view taken on line 3—3 in FIG. 2.

FIG. 4 is a sectional view on line 4—4 in FIG. 3.

FIG. 5 is a fragmentary side elevational view of the FIG. 2 bow structure.

DESCRIPTION OF A PREFERRED EMBODIMENT OF THE INVENTION

Figure 6:
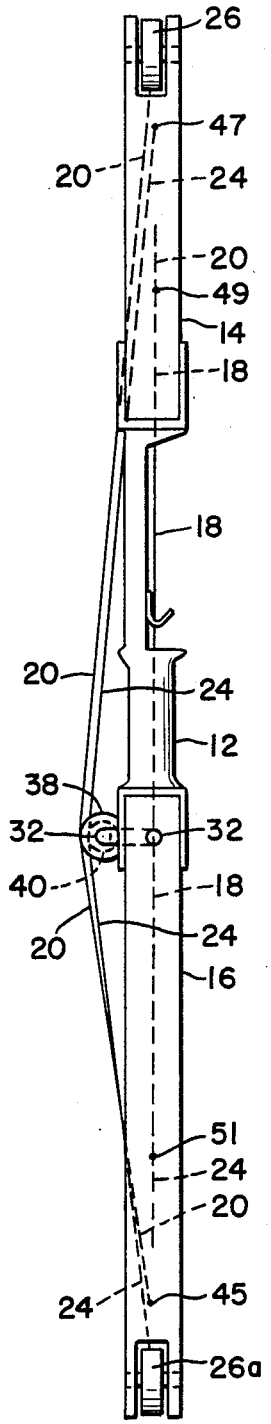
FIG. 6 is a semi-diagrammatic front elevational view of the FIG. 2 structure showing cable arrangements.

FIG. 1 illustrates a prior art arrangement wherein archery bow 10 comprises a central hand grip section 12, upper limb 14, and lower limb 16. FIG. 5 shows a conventional mechanism for anchoring (suspending) two force-multiplying cables 20 and 24 between the free ends of the bow limbs and a bowstring 18.

Cable 20 extends downwardly from anchorage 22 around a non-illustrated pulley (at the free end of the bow lower limb), thence upwardly to a connection with bowstring 18. Cable 24 extends upwardly from an anchorage at the free end of limb 16, around pulley 26 to a connection 28 with bowstring 18. The cable-pulley arrangement is conventional.

FIG. 1 shows a conventional cable guide structure 30 extending from a midpoint on bow 10. The guide structure comprises a support rod 32 extending rearwardly from the bow generally normal to hand grip section 12. A grooved block 34 is slidably positioned on rod 32 for adjustment in the arrow 36 direction as the cables change direction during pull back of bowstring 18.

FIGS. 2 through 4 illustrate a cable guard constructed according to my invention. The guide employs a circular cross-sectioned rod 32 that may be identical to the rod used in the FIG. 1 prior art arrangement. Freely encircling support rod 32 are two separate unconnected rollers 38 and 40. Each roller can rotate independently on rod 32 (in opposite directions and at different rotational speeds). the general plane of the bow structure.

Additionally, each roller can freely slide axially on rod 32 in the arrow 36 direction.

Each roller is formed of a low friction rigid plastic material, e.g. the plastic material marketed under the trademark "TURKITE" or the material marketed under the trademark "TEFLON". Each roller has a peripheral groove 42 or 44 for retaining the associated cable against slipping off the roller periphery.

An important feature of my invention is the fact that roller 38 has a significantly larger diameter than roller 40. During service (pullback of bowstring 18) the two rollers rotate in opposite directions without any contact between the two cables 20 and 24 at any point along the cable span (between the two cable anchorages).

Each cable crosses the nominal cable pathline defined by an imaginary plane through the pulley axis (at the free ends of the bow limbs). By making rollers 38 and 40 with different diameters the two cables cross the nominal cable pathline at different points along the cable span. The cables are prevented from contact, as would cause them to frictionally rub together to decrease the cable life and generate disturbing noise. The diameter of the smaller diameter may preferably be about seventy percent of that of the large diameter roller. The rollers might typically have diameters of $\frac{3}{4}''$ and $1''$, respectively, with each having a groove $0.040''$ deep. The difference in diameters of the rollers spaces the cables apart in the direction laterally of the general plane of the bow structure.

Noise is an annoyance to the archer during the arrow-aiming and string pull-back period. To minimize noise production roller 40 may have a sound-suppression disk 43 adhered to the side surface thereof that faces roller 38. Disk 43 may be formed of a felt material to suppress squeak-type sounds that could be generated by direct contact between two hard plastic surfaces.

FIG. 6 shows the cable spacing, as seen looking at the front edge surface of the bow. The anchorages for cables 20 and 24 are indicated by numerals 45 and 47. In practice the cable anchorages can be formed by looping the respective cables around the associated pulley shafts in the manner shown in FIG. 5, relative to anchor 22.

It will be seen that support rod 32 is offset from the general plane of the bow structure, so that rollers 38 and 40 have peripheral edges spaced laterally outbound of the general plane of the bow structure, thus to prevent interference by the rollers with the position and movement of an arrow during draw-back and firing.

In FIG. 6 the connections between bowstring 18 and the ends of cables 20 and 24 are indicated by reference numerals 49 and 51. The cable sections that are trained around pulleys 26 and **26*a* are not shown in FIG. 6**.

The cable sections above rollers 38 and 40 are spaced from each other along the entire span, from the rollers to the upper end of bow limb 14. The cable sections below rollers 38 and 40 cross one another but do not come into contact because cable 20 is behind cable 24 at the point where the two cables cross, as viewed. Cable separation along the entire cable span (between pulleys 26 and 26a) is maintained by the rollers 38 and 40 being of different diameters, typically about ¼" difference in diameters, thereby spacing apart the cables in the direction laterally of the general plane of the bow structure. This relationship is an important feature of my invention.

Thus there has been shown and described a novel Archery Bow Cable Guide which fulfills all the objects and advantages sought therefor. Many changes, modifications, variations and other uses and applications of the subject invention will, however, become apparent to those skilled in the art after considering this specification together with the accompanying drawings and claims. All such changes, modifications, variations and other uses and applications which do not depart from the spirit and scope of the invention are deemed to be covered by the invention which is limited only by the claims which follow.

The inventor claims:

1. A cable guard device for attachment to a compound bow having a central hand grip section, upper and lower limbs, a first anchorage and first pulley means at the free end of the upper limb, a second anchorage and second pulley at the free end of the lower limb, a bow string extending between the free ends, a first cable extending from the first anchorage means and about the second pulley means to one end of the bow string, and a second cable extending from the second anchorage means and about the first pulley means to the other end of the bow, the cable guard device comprising:

a rod for mounting on a mid-portion of the central hand grip section to extend rearwardly therefrom generally normal thereto, and to the region of said bow string extending between the free ends of the upper and lower bow limbs, said first and second cables extending between respective ones of the first and second pulley means and respective ones of the second and first anchorage means, first and second rollers rotatably mounted on the rod in said region of the bow string, the rollers being slidable axially on the rod, each of the rollers having a peripheral groove for guiding engagement with one of the first and second cables, the first and second rollers being of different diameters to maintain the first and second cables in spaced relation radially outwardly of the rod to prevent contact between the first and second cables throughout the length of the cables whereby wear and shortened service life of the oppositely moving cables are prevented, and an annular sound-suppression disk disposed about the rod and between the first and second rollers.

2. The device according to claim 1, wherein:

the annular sound-suppression disk is carried on a side surface of one of the rollers.

3. In a compound bow comprising a central hand grip section, upper and lower limbs, a first anchorage and first pulley means at the free end of the upper limb, a second anchorage and second pulley at the free end of the lower limb, a bow string extending between the free ends, a first cable extending from the first anchorage means and about the second pulley means to one end of the bow string, and a second cable extending from the second anchorage means and about the first pulley means to the other end of the bow, a cable guard comprising:

rod means for mounting on a mid-portion of the central hand grip section to extend rearwardly therefrom generally normal thereto, and to the region of said bow string extending between the free ends of the upper and lower bow limbs, said first and second cables extending between respective ones of the first and second pulley means and respective ones of the second and first anchorage means, first and second rollers rotatably mounted on the rod in said region of the bow string, the rollers being slidable axially on the rod, each of the rollers having a peripheral groove for guiding engagement with one of the first and second cables, the first and second rollers being of different diameters to maintain the first and second cables in spaced relation radially outwardly of the rod to prevent contact between the first and second cables throughout the length of the cables whereby wear and shortened service life of the oppositely moving cables are prevented, and an annular sound-suppression disk disposed about the rod and between the first and second rollers.

4. The device according to claim 3, wherein:

the annular sound-suppression disk is carried on a side surface of one of the rollers.

* * * * *